US007439459B2

(12) United States Patent
Hyun et al.

(10) Patent No.: US 7,439,459 B2
(45) Date of Patent: Oct. 21, 2008

(54) SWITCH DEVICE AND STEERING SWITCH APPARATUS EQUIPPED WITH THE SWITCH DEVICE

(75) Inventors: Choi Nok Hyun, Miyagi-ken (JP); Mikio Shirakawa, Miyagi-ken (JP); Tatsuya Yokoyama, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/513,653

(22) Filed: Aug. 30, 2006

(65) Prior Publication Data

US 2007/0051592 A1 Mar. 8, 2007

(30) Foreign Application Priority Data

Sep. 5, 2005 (JP) ..... 2005-256917
Sep. 5, 2005 (JP) ..... 2005-256919
Sep. 5, 2005 (JP) ..... 2005-256920

(51) Int. Cl.
*H01H 9/00* (2006.01)

(52) U.S. Cl. ..... 200/5 R; 200/61.54

(58) Field of Classification Search ..... 200/4, 200/5 R, 14, 17 R, 18, 1 B, 336, 339, 61.54, 200/61.56, 61.57, 553; 341/35; 345/184
See application file for complete search history.

(56) References Cited

U.S. PATENT DOCUMENTS 4,918,264 A 4/1990 Yamamoto et al.
5,426,275 A * 6/1995 Maeda et al. ..... 200/553
6,420,669 B1 * 7/2002 Shenker et al. ..... 200/339
6,437,259 B1 * 8/2002 Geppert et al. ..... 200/5 R
6,559,398 B2 * 5/2003 Takeda et al. ..... 200/339
6,800,825 B1 * 10/2004 Sasaki et al. ..... 200/402
6,852,936 B2 * 2/2005 Hayashi et al. ..... 200/61.54
6,911,612 B2 * 6/2005 Seki ..... 200/339
6,914,201 B2 * 7/2005 Van Vooren et al. ..... 200/1 B
6,914,202 B2 * 7/2005 Sugimoto et al. ..... 200/1 B
6,956,179 B2 * 10/2005 Gillman et al. ..... 200/302.3

FOREIGN PATENT DOCUMENTS

DE 42 39 513 A1 5/1994
GB 2 273 203 A 6/1994
JP 8-7701 1/1996

OTHER PUBLICATIONS

European Search Report issued in corresponding European Patent Application No. 06018239.1; mailed May 26, 2008.

* cited by examiner

*Primary Examiner*—Michael A Friedhofer
(74) *Attorney, Agent, or Firm*—Brinks Hofer Gilson & Lione

(57) ABSTRACT

A switch device is provided. A switch device includes a housing. A circuit board is provided with fixed contacts. A rubber sheet is disposed on the circuit board and has protuberances, a tiltably-supported actuator, a rotatable knob, and a torsional coil spring serving as a restoring spring. The actuator is disposed adjacent to the rotatable knob. The rotatable knob is provided with a drive portion, which extends through a cutout in the actuator so as to be slidably engaged to engagement portions of the actuator.

14 Claims, 6 Drawing Sheets

SWITCH DEVICE AND STEERING SWITCH APPARATUS EQUIPPED WITH THE SWITCH DEVICE

This application claims the benefit of Japanese Patent Application No. 2005-256917 filed on Sep. 5, 2005, Application No. 2005-256919 filed on Sep. 5, 2005 and Japanese Patent Application No. 2005-256920 filed on Sep. 5, 2005 which are both hereby incorporated by reference.

BACKGROUND

1. Field

The present embodiments relate to a switch device.

2. Related Art

A typical example of a switch device of this type is disclosed in Japanese Unexamined Patent Application Publication No. 8-7701 (pages 3 to 4, FIG. 1). Such a switch device includes a pair of switch units disposed on a circuit board inside a housing. An actuator is disposed over the two switch units. A tiltable operating member is disposed on the actuator. In this conventional switch device, the operating member tiltably supported within the housing is partly exposed through a window of the housing so that a portion of the operating member can be manually operated by an operator. When the operating member is operated, one end of the actuator is pushed inward so that the switch unit disposed below that end is pressed. Accordingly, by selectively pushing the opposite ends of the actuator using the operating member, switch-on signals can be selectively output from the pair of switch units.

The conventional switch device described above requires an installation space inside the housing for stacking the switch units and the actuator below the operating member. This leads to an increase in the height of the housing, which makes a low-profile structure for the entire device difficult to achieve.

In the conventional switch device described above, the actuator is interposed between the operating member and the switch units. Thus, the actuator can be held in position only after an installation process for the operating member is completed. The actuator is apt to become displaced or detached at an assembly stage, which is one of significant factors that lower the assembly efficiency. In the conventional example, since the operating member has to be used for pushing the actuator downward, the operating method of the operating member is extremely limited. For example, it is difficult to apply the conventional example to a switch device of a sliding type.

Accordingly, a low-profile switch device in which a pair of switch units can be selectively pushed, and a steering switch apparatus equipped with such a switch device is desired. A switch device having enhanced assembly properties and applicable to various operating types, and a steering switch apparatus equipped with such a switch device is also desired.

SUMMARY

The present embodiments are directed to a switch device, which may obviate one or more of the problems due to the limitations and disadvantages of the related art.

In a first embodiment, a switch device includes a housing having a window in an operating surface. An operating member is rotatably supported within the housing and is partly exposed through the window. A pair of switch units are disposed on a circuit board in the housing and generate an elastic repulsive force against a pushing force. An actuator tiltably supported within the housing and having a pair of ends are respectively disposed on the pair of switch units. The actuator is disposed adjacent to the operating member.

The operating member has a rotating shaft whose one end is provided with a drive portion that is given a predetermined radius of rotation. The drive portion is slidably engaged to the actuator. The drive portion tilts the actuator in response to a rotating operation performed on the operating member so that one of the ends pushes the corresponding switch unit.

According to the switch device described above, the drive portion of the operating member tilts the actuator, disposed adjacent to the operating member, in response to a rotating operation so that one of the ends of the actuator pushes the corresponding switch unit disposed below the end. Accordingly, since the actuator and the switch units are disposed adjacent to a side of the operating member, the housing is reduced in height, thereby facilitating a low-profile structure.

A central section of the actuator in a tilting direction thereof is preferably provided with a notch-like or slit-like cutout through which the drive portion extends, the extending section of the drive portion being parallel to an axial direction of the rotating shaft of the operating member. The actuator can be tilted smoothly when the drive portion is rotated in response to a rotating operation. Accordingly, this allows for a stable operation of an operating-force transmission mechanism.

The switch device may further include a restoring spring that is engaged to the operating member within the housing and generates a restoring force in response to the rotating operation. Consequently, in a non-operative state, even if there is a backlash between the drive portion of the operating member and the actuator, the operating member itself can be maintained in a backlash-free state by means of the restoring spring. This allows for the dimensional accuracy to be set relatively roughly, and achieves lower component costs and enhanced assembly properties.

In one exemplary embodiment, the housing may include an upper case having the window and a lower case to which the upper case is attached. Moreover, the actuator may be tiltably supported by the lower case and the operating member may be rotatably supported by the lower case. For example, the circuit board, the switch units, the actuator, and the operating member, can all be assembled together in the lower case, and the assembly process can be completed by attaching the upper case to the lower case. Accordingly, a switch device having enhanced assembly properties is achieved.

In one exemplary embodiment, each of the switch units may include a fixed contact fixed on the circuit board. A dome body is disposed on the circuit board and surrounds the fixed contact, the dome body capable of being elastically buckled. A movable contact is attached to an interior of the dome body and facing the fixed contact in a manner such that the movable contact is capable of moving into and out of contact with the fixed contact. In this embodiment, the movable contact moves into contact with the fixed contact when the dome body is pushed and becomes buckled. This significantly enhances the dustproof and moisture-proof properties in each contact section, and also allows each dome body to generate a relatively large elastic repulsive force and to clearly produce a feel of a click. Accordingly, with a simple structure, improvements in reliability and haptic feedback are achieved.

In another exemplary embodiment, the housing is installed in a steering wheel. As described above, the switch device includes the housing having the window in the operating surface thereof. The operating member is rotatably supported within the housing and is partly exposed through the window. The pair of switch units are disposed on the circuit board in the housing and generate an elastic repulsive force against a pushing force. The actuator is tiltably supported within the housing and has a pair of ends that are respectively disposed on the pair of switch units. The actuator is disposed adjacent to the operating member. The operating member has the rotating shaft whose one end is provided with the drive portion that is given a predetermined radius of rotation, the drive portion being slidably engaged to the actuator, the drive portion tilting the actuator in response to a rotating operation performed on the operating member so that one of the ends pushes the corresponding switch unit.

Accordingly, the housing is reduced in height, thereby achieving a low-profile steering switch apparatus in which the pair of switch units can be selectively pushed.

In another embodiment, the switch device includes a circuit board disposed inside a housing. A rubber sheet is disposed on the circuit board and has protuberances at a plurality of positions, the protuberances are capable of being elastically buckled. A tiltably-supporting portion is provided inside the housing in an area where the circuit board and the rubber sheet are not present. An actuator is tiltably supported by the tiltably-supporting portion. An operating member has a drive portion engaged to the actuator and is partly exposed on an exterior of the housing. Each of the protuberances has a movable contact disposed therein. The movable contact faces a corresponding one of fixed contacts provided on the circuit board in a manner such that the movable contact is capable of moving into and out of contact with the fixed contact. The actuator has ends that are respectively disposed on the corresponding protuberances in a manner such that each end is elastically in contact with the corresponding protuberance. When the operating member is operated, the drive portion tilts the actuator so that one of the ends buckles the corresponding protuberance.

According to this embodiment the opposite ends of the actuator are tiltably supported by the tiltably-supporting portion in the housing and are respectively disposed on the corresponding protuberances of the rubber sheet disposed on the circuit board in a manner such that each end elastically contacts the corresponding protuberance. Therefore, at an assembly stage, the actuator can be set in a preloaded state in which the ends receive a reactive force from the protuberances disposed below the ends. This allows the actuator to be installed in the housing in a backlash-free positioned state, and prevents the rubber sheet from becoming displaced or detached by means of the ends of the actuator, whereby high assembly efficiency is achieved.

As an alternative to a downward driving force, the actuator is tiltably supported by the tiltably-supporting portion can be tilted readily in response to an oblique or lateral driving force. Accordingly, the switch device is readily applicable to various operating types, such as a rotating type and a sliding type.

The actuator is rotatably attached to the tiltably-supporting portion in a snap-fit fashion. This contributes to higher assembly efficiency. For example, the actuator may include a tilting shaft whose center of axle is aligned with a tilting axis of the actuator, and the tiltably-supporting portion in the housing may include a pair of walls standing substantially in parallel to each other, the walls being respectively provided with shaft holes at opposing positions of the walls. Opposite ends of the tilting shaft may be rotatably attached to the shaft holes. Thus, at the time of an assembly process, the tilting shaft of the actuator may be press-fitted into a space between the pair of walls so that the actuator can be readily joined to the tiltably-supporting portion in a snap-fit fashion.

According to another embodiment, a housing is installed in a steering wheel. A switch device includes the circuit board disposed inside the housing. The rubber sheet is disposed on the circuit board and having the protuberances at a plurality of positions, the protuberances capable of being elastically buckled. The tiltably-supporting portion is provided inside the housing in an area where the circuit board and the rubber sheet are not present. The actuator is tiltably supported by the tiltably-supporting portion. The operating member has the drive portion engaged to the actuator and is partly exposed on an exterior of the housing. Each of the protuberances has the movable contact disposed therein, the movable contact facing a corresponding one of fixed contacts provided on the circuit board in a manner such that the movable contact is capable of moving into and out of contact with the fixed contact. The actuator has the ends that are respectively disposed on the corresponding protuberances in a manner such that each end is elastically in contact with the corresponding protuberance. When the operating member is operated, the drive portion tilts the actuator.

Accordingly, the opposite ends of the actuator tiltably supported by the tiltably-supporting portion in the housing are respectively disposed on the corresponding protuberances of the rubber sheet disposed on the circuit board in a manner such that each end is elastically in contact with the corresponding protuberance. Therefore, at an assembly stage, the actuator can be set in a preloaded state in which the ends receive a reactive force from the protuberances disposed below the ends. This allows the actuator to be installed in the housing in a backlash-free positioned state, and prevents the rubber sheet from becoming displaced or detached by means of the ends of the actuator. Accordingly, a steering switch apparatus that allows for high assembly efficiency is achieved.

In the switch device according to a present embodiment, the drive portion of the operating member tilts the actuator, disposed adjacent to the operating member, in response to a rotating operation so that one of the ends of the actuator pushes the corresponding switch unit disposed below the end. Accordingly, since the actuator and the switch units are disposed adjacent to a side of the operating member, the housing is reduced in height. Thus, a low-profile switch device is achieved in which a pair of switch units can be selectively pushed.

In a present embodiment, the opposite ends of the actuator are disposed on the corresponding protuberances of the rubber sheet in a manner such that each end is elastically in contact with the corresponding protuberance. Therefore, at an assembly stage, the actuator can be set in a preloaded state. This allows the actuator to be installed in the housing in a backlash-free positioned state, and prevents the rubber sheet from becoming displaced or detached by means of the ends of the actuator, whereby high assembly efficiency is achieved. Alternatively, the actuator is tiltably supported by the tiltably-supporting portion can be tilted readily in response to an oblique or lateral driving force. Accordingly, a highly versatile switch device that is at least readily applicable to various operating types is achieved.

DETAILED DESCRIPTION

Figure 3:
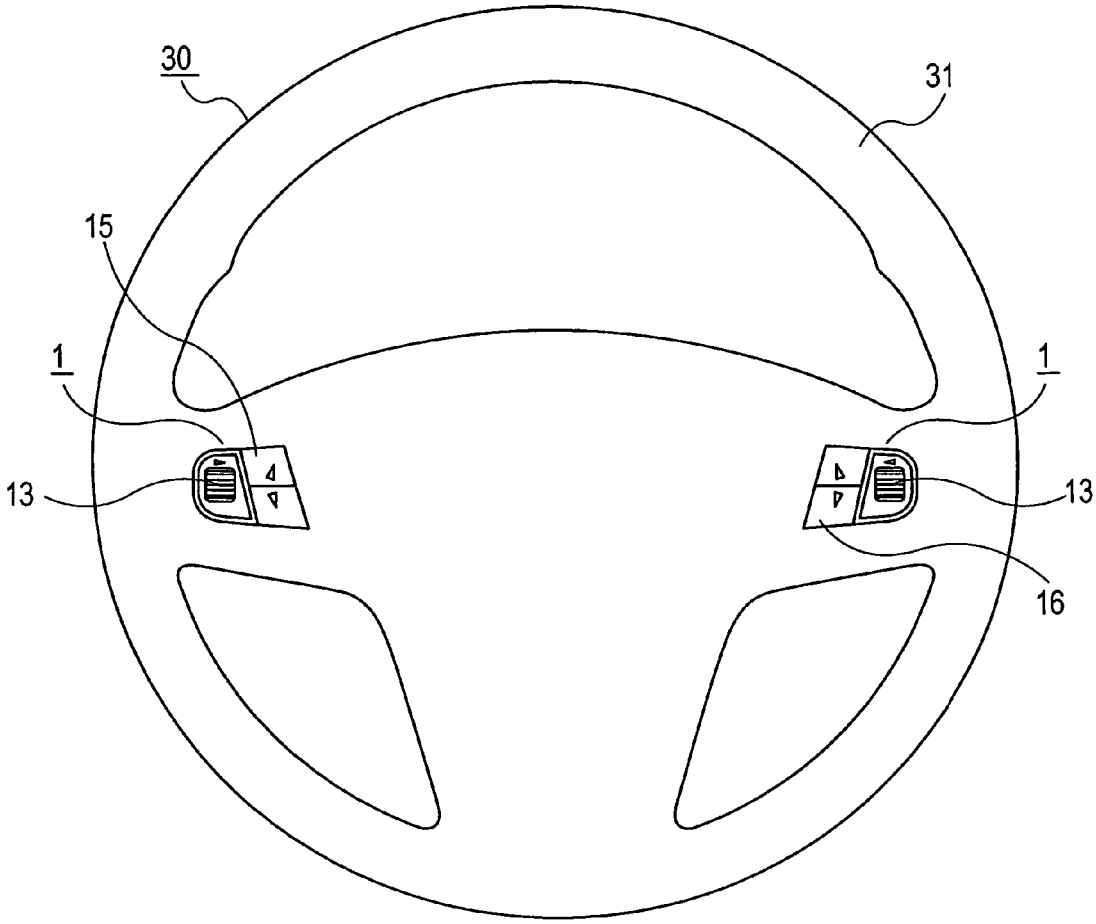
FIG. 3 is a front view of a steering wheel equipped with a steering switch apparatus including the switch devices.

FIG. 3 illustrates a steering switch apparatus which includes a pair of left and right switch devices 1 according to an embodiment disposed within a circular ring portion 31 of a steering wheel 30 of a vehicle. The pair of steering devices 1 is bisymmetrical to each other, and the basic structure between the two is substantially the same. Therefore, the description below will only refer to the switch device 1 disposed on the right side of FIG. 3.

Figure 2:
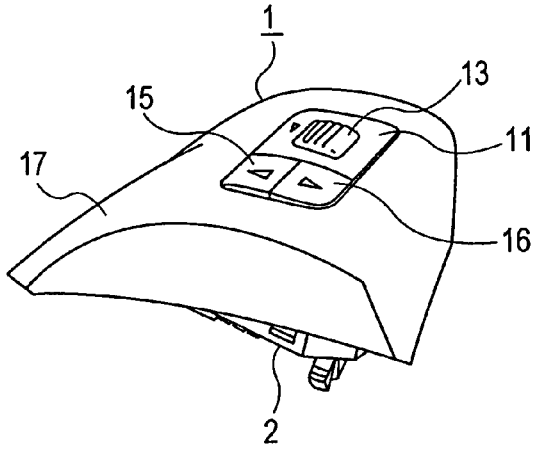
FIG. 2 is a perspective view showing a exemplary embodiment in an assembled state.

As shown in FIG. 2, the switch device 1 mainly includes a lower case 2 having, for example, positioning pins 3 and a tiltably-supporting portion 4 projected therefrom. A circuit board 6 is disposed inside the lower case 2 and has a wiring pattern that includes fixed contacts 7 on an upper surface of the circuit board 6. A rubber sheet 8 is disposed on the circuit board 6 and has a plurality of dome-shaped protuberances 8*a*. An actuator 9 has a tilting shaft 9*a* tiltably supported by the tiltably-supporting portion 4 and ends 9*b* disposed on the protuberances 8*a*. An upper case 10 is attached on the lower case 2 so as to cover the circuit board 6 and the rubber sheet 8. A frame-like case 11 has a window 11*a* and is combined with the upper case 10. A rotatable knob 13 is rotatably supported within the lower case 2 and partly exposed through the window 11*a*, A torsional coil spring 14 is wound around a rotating shaft 13*a* of the rotatable knob 13 and serves as a restoring spring during a rotating operation. Two operating keys 15, 16 are supported by the upper case 10 in a vertical movable fashion at two positions adjacent to the frame-like case 11 and whose lower ends are disposed on the protuberances 8*a*. A cover body 17 has an opening 17*a* and covers the lower case 2 and the upper case 10.

A rotating operation can be implemented using the rotatable knob 13, and a pushing operation can be implemented using the operating key 15 or 16. When one of the operations is selectively performed, the corresponding protuberance 8*a* becomes elastically buckled so as to generate a feel of a click. At the same time, for example, a movable contact 18 provided in the protuberance 8*a* comes into contact with the corresponding fixed contact 7 on the circuit board 6, thereby switching to an ON-state (see FIG. 5). The lower case 2, the upper case 10, and the frame-like case 11 constitute a housing 19. For example, the circuit board 6, the rubber sheet 8, the actuator 9, the torsional coil spring 14, are housed within an internal space of the housing 19. The rotatable knob 13 and the operating keys 15, 16 are manually operable by being exposed on an upper surface of the housing 19.

The lower case 2 contains positioning pins 3 for positioning the circuit board 6 and the rubber sheet 8. The tiltably-supporting portion 4 defined by a pair of walls 4*b* has shaft holes 4*a* for the actuator 9. A supporting wall 12 has a shaft notch 12*a* for the rotatable knob 13. The pair of walls 4*b* stands substantially in parallel to each other and has the shaft holes 4*a* at positions that face each other. One side portion inside the lower case 2 is provided with an array of terminal holes 2*a*. The other side portion inside the lower case 2 is provided with a shaft hole 2*b* for the rotatable knob 13 at a position facing the shaft notch 12*a*. Opposite arm segments 14*a* of the torsional coil spring 14 are elastically contactable with inverted-trapezoidal-shaped engagement step portions 5 that are disposed near the shaft hole 2*b*.

The circuit board 6 disposed inside the housing 19 is substantially parallel to the window 11*a*. The circuit board 6 has the wiring pattern (not shown) including the fixed contacts 7 provided thereon, and is provided with LEDs 20 for light emission and terminals 21 for external connection. The circuit board 6 also has a plurality of through holes 6*a* through which the positioning pins 3 extend, and a cutout section 6*b* that provides an installation space for the tiltably-supporting portion 4. In a state where the positioning pins 3 are inserted through the corresponding through holes 6*a* and the terminals 21 are inserted through the corresponding terminal holes 2*a*, the circuit board 6 is fixed accurately in position onto the lower case 2.

Figure 5:
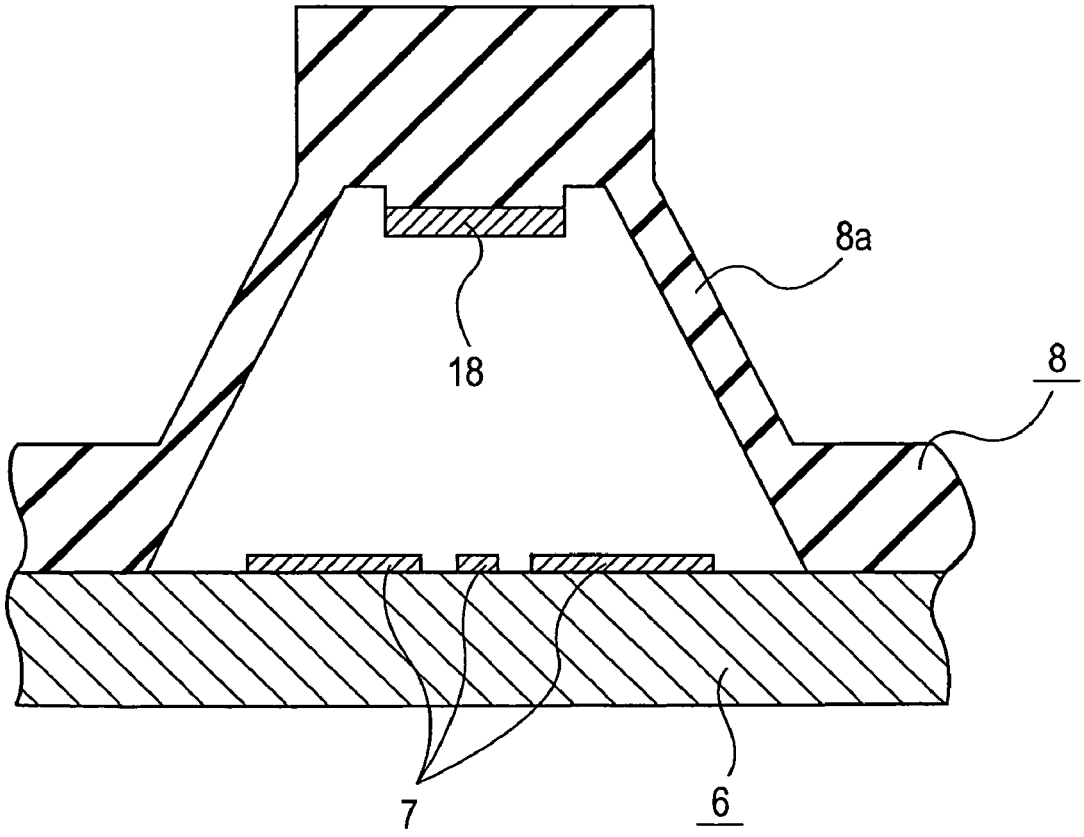
FIG. 5 is a cross-sectional diagram showing a relevant portion of a rubber sheet incorporated in the switch device.

The rubber sheet 8 is an integrally molded component formed of elastic rubber. Protruding from a sheet-like area of the rubber sheet 8 are six protuberances 8*a* deformable in a buckling manner, two pin-engagement portions 8*b* to be capped on the positioning pins 3, and two angular tubes 8*c* for holding the LEDs 20 therein. The rubber sheet 8 is provided with a cutout section 8*d* at a position directly above the cutout section 6*b* of the circuit board 6 so as to provide an installation space for the tiltably-supporting portion 4. The rubber sheet 8 is secured on the circuit board 6 in a positioned state in which the pin-engagement portions 8*b* are engaged to the corresponding positioning pins 3. As shown in FIG. 5, the movable contact 18 attached to a ceiling face of each protuberance 8*a* faces the corresponding fixed contact 7 and is capable of moving into or out of contact with the fixed contact 7.

Figure 4A:
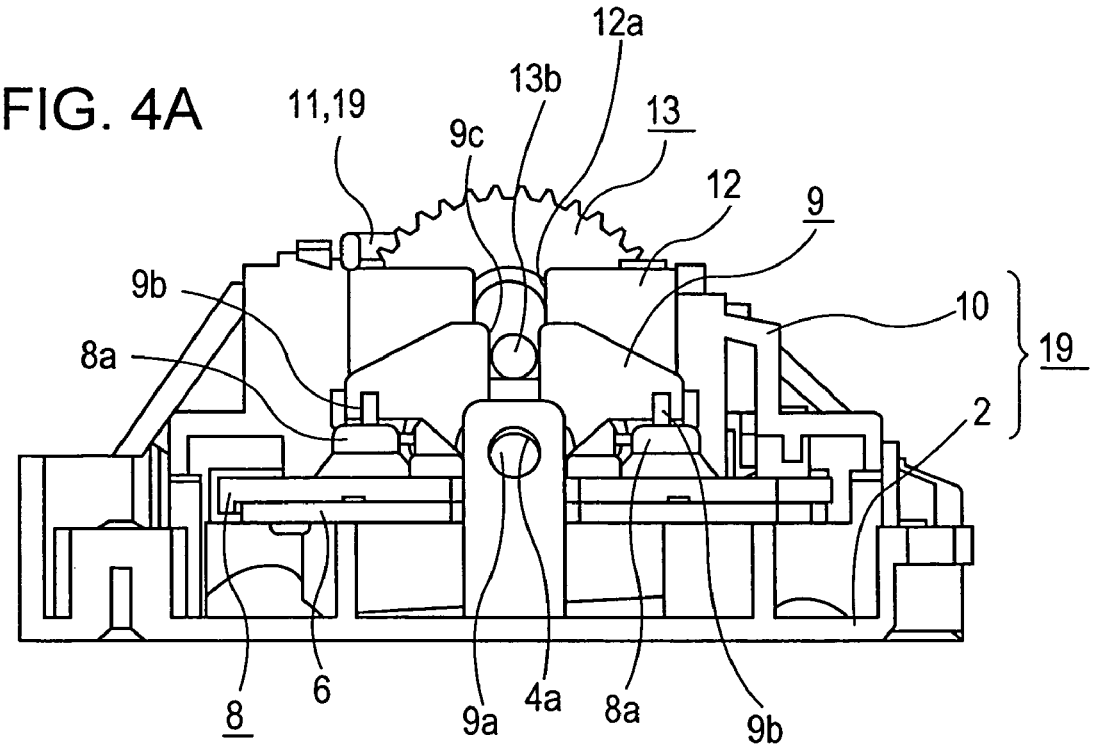
FIGS. 4A and 4B are operational diagrams showing a rotating operation performed on the switch device.
Figure 4B:
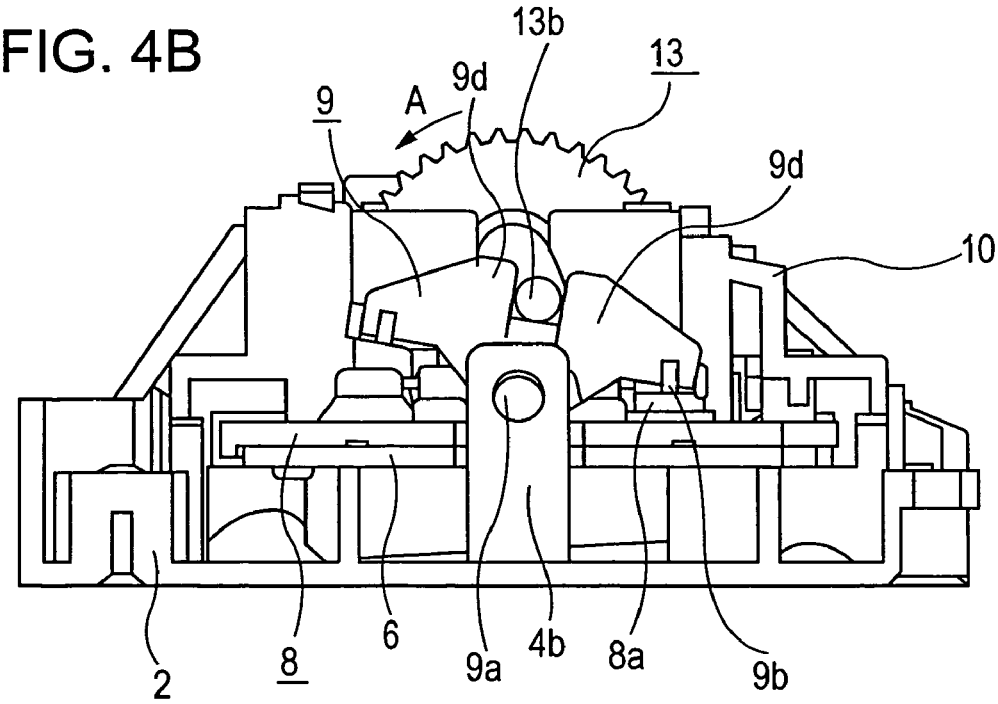

The actuator 9 has the tilting shaft 9*a* whose center of axle is aligned with the tilting axis of the actuator 9. The tilting shaft 9*a* has its opposite ends rotatably engaged to the shaft holes 4*a* of the pair of walls 4*b* so that the actuator 9 is tiltably supported by the tiltably-supporting portion 4. Referring to FIGS. 4A and 4B, the actuator 9 is bilaterally symmetrical with respect to the tilting shaft 9*a*. The ends 9*b* of the actuator 9 are set in an elastically contactable fashion on two of the protuberances 8*a* that are arranged in a line across the cutout section 8*d*. For example, at an assembly stage, the tilting shaft 9*a* of the actuator 9 is press-fitted into a space between the pair of walls 4*b* until the ends 9*b* are set on the corresponding protuberances 8*a*. The opposite ends of the tilting shaft 9*a* are then fitted to the shaft holes 4*a* so as to become rotatably supported by the shaft holes 4*a*. Thus, the actuator 9 becomes joined to the tiltably-supporting portion 4 in a snap-fit fashion. Consequently, the actuator 9 is maintained in a preloaded state in which the ends 9*b* receive a reactive force from the corresponding protuberances 8*a*.

The actuator 9 is disposed adjacent to the supporting wall 12, which is positioned adjacent to one side of the rotatable knob 13. A central section of the actuator 9 in a tilting direction thereof has a notch-like cutout 9*c*. The rotatable knob 13 has a drive portion 13*b* which extends through the cutout 9*c* in a vertical movable fashion. Inner surfaces of the actuator 9 that face each other across the cutout 9*c* serve as engagement portions 9*d* to which the drive portion 13*b* is slidably engaged. When the rotatable knob 13 is rotated, the drive portion 13*b* rotates together with the rotatable knob 13 and thus biases one of the engagement portions 9*d* in one direction. Thus, the actuator 9 is tilted in the one direction around the tilting shaft 9*a*, whereby the biased end 9*b* moves downward and pushes against the corresponding protuberance 8*a*.

The rotatable knob 13 is formed into a substantially semi-columnar shape that includes the rotating shaft 13*a*. The opposite ends of the rotating shaft 13*a* are rotatably supported by the shaft notch 12*a* of the supporting wall 12 and the shaft hole 2*b* of the lower case 2. Projected from an end of the rotating shaft 13*a* proximate to the shaft notch 12*a* is the drive portion 13*b*, which has an L-shape and extends from the exterior of the supporting wall 12.

Figure 1:
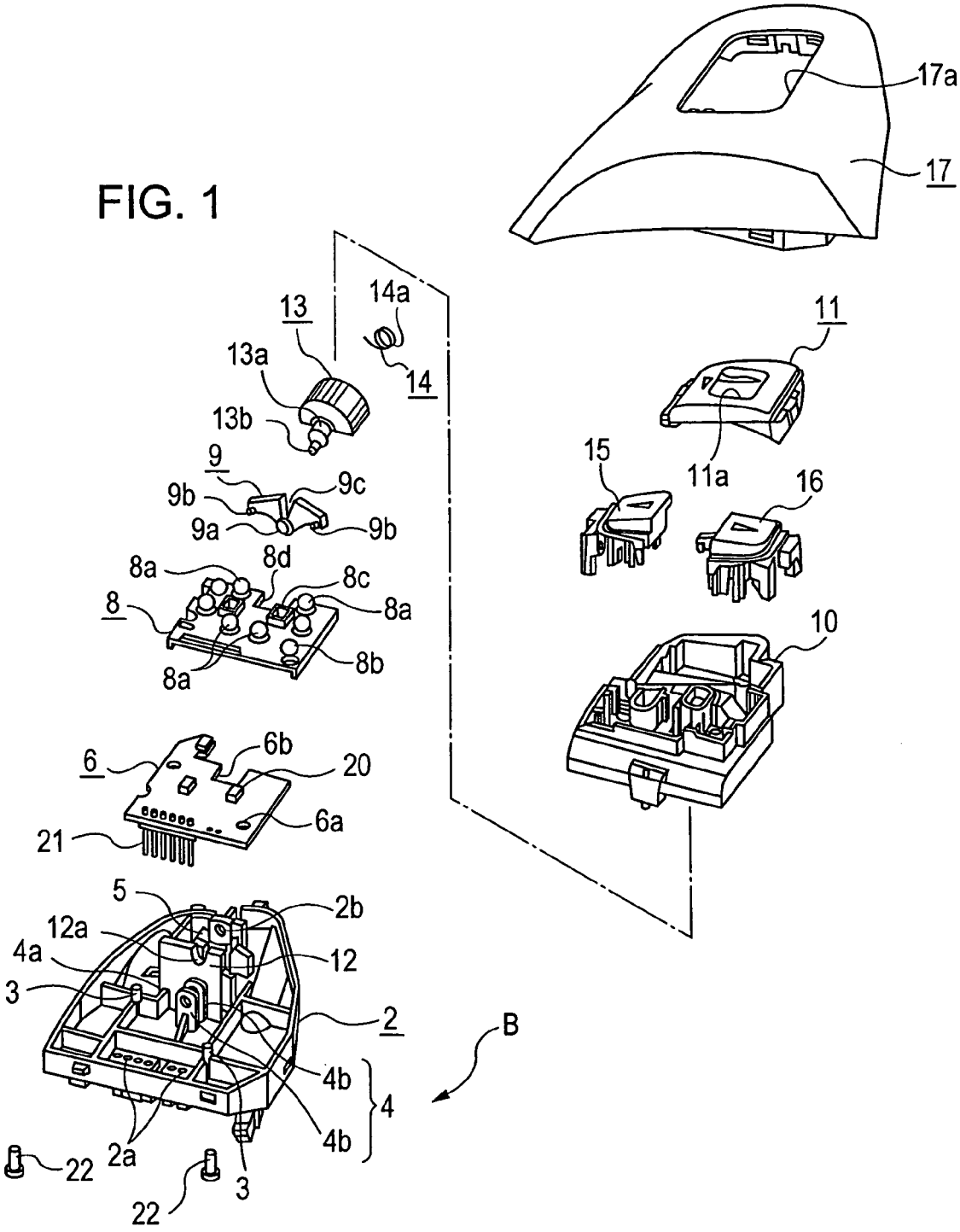
FIG. 1 is an exploded perspective view of a switch device according to an exemplary embodiment.
Figure 6A:
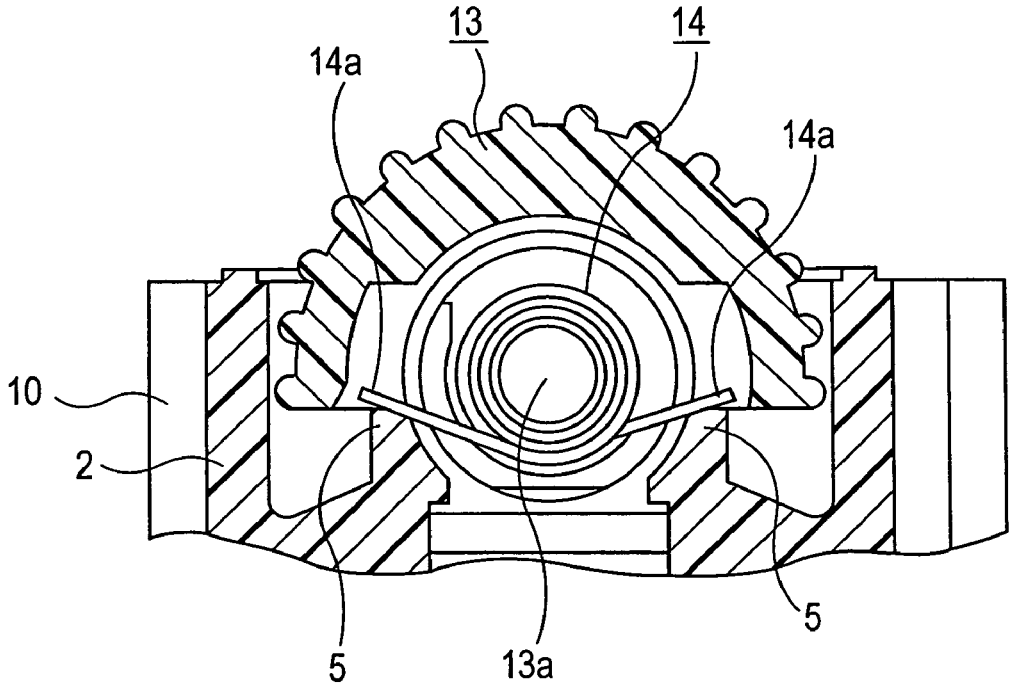
FIGS. 6A and 6B are diagrams showing an operation of a restoring spring incorporated in the switch device.
Figure 6B:
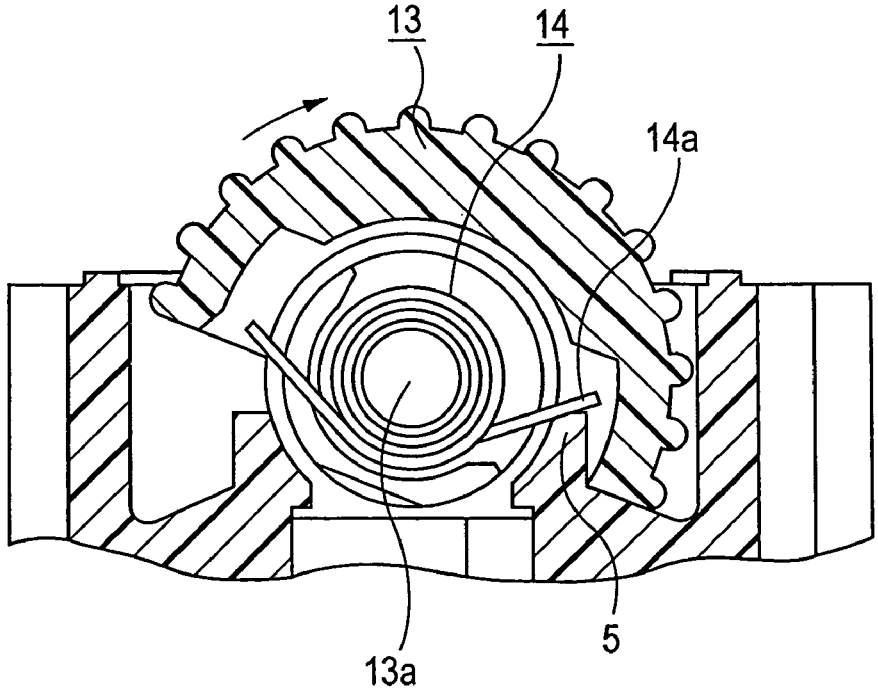

A front end of the drive portion 13*b* is given a predetermined radius of rotation and extends through the cutout 9*c* of the actuator 9 in a direction parallel to the axial direction of the rotating shaft 13*a*. The torsional coil spring 14 is wound around an end of the rotating shaft 13*a* of the rotatable knob 13 proximate to the shaft hole 2*b*. Referring to FIG. 6A, both of the arm segments 14*a* of the torsional coil spring 14 are elastically in contact with the engagement step portions 5 in the lower case 2. Consequently, when the rotatable knob 13 is rotated, one of the arm segments 14*a* in the rotating direction is pressed hard against the corresponding engagement step portion 5 and thus generates an elastic repulsive force. Due to this elastic repulsive force, the rotatable knob 13 can return automatically to its original position after the rotating operation. FIGS. 6A and 6B are cross-sectional views as viewed in a direction of an arrow B shown in FIG. 1, for example, in a direction from the shaft hole 2*b* of the lower case 2 towards the shaft notch 12*a* of the supporting wall 12.

The frame-like case 11 is attached to a predetermined position of the upper case 10. The upper case 10 is secured on the lower case 2 with appropriate means, such as screws 22 and caulking. The upper case 10 supports the operating keys 15, 16 in a vertically movable fashion. The upper surfaces of the operating keys 15, 16 are exposed at two sections that are adjacent to the frame-like case 11. Although the present embodiment is directed to an example in which the separate frame-like case 11 is post-attached to the upper case 10, the upper case 10 and the frame-like case 11 may alternatively be a single-piece component formed by integral molding.

The cover body 17 is secured to the outer walls of the lower case 2 with appropriate means, for example, in a snap-fit fashion. The rotatable knob 13 exposed on the frame-like case 11 and the operating keys 15, 16 are exposed through the opening 17*a* of the cover body 17. Thus, an operator can selectively rotate the rotatable knob 13 or push the operating key 15 or 16 by moving his/her finger within the opening 17*a*.

An operation implemented in response to a rotation of the rotatable knob 13 will be described mainly with reference to FIGS. 4A and 4B. In a neutral state shown in FIG. 4A, when an operator manually rotates the rotatable knob 13, the torsional coil spring 14 bends inside the lower case 2, and the drive portion 13*b* rotates together with the rotatable knob 13 so as to drive the actuator 9. Thus, the actuator 9 pushes against a predetermined one of the protuberances 8*a*. For example, as shown in FIG. 4B, when the rotatable knob 13 is rotated in a direction indicated by an arrow A, the drive portion 13*b* in the cutout 9*c* of the actuator 9 rotates while pushing against the engagement portion 9*d* on the right side of the drawing. Thus, the actuator 9 is tilted clockwise around the tilting shaft 9*a*, whereby the right end 9*b* moves downward while pushing the protuberance 8*a* disposed below the right end 9*b*. As a result, the protuberance 8*a* becomes elastically buckled and thus generates a feel of a click.

The movable contact 18 inside the protuberance 8*a* comes into contact with the corresponding fixed contact 7, whereby a switch-on signal is output. If the rotatable knob 13 is rotated in a direction opposite to the direction of the arrow A, the same operation is implemented, but in that case, the left end 9*b* in FIGS. 4A and 4B pushes the protuberance 8*a*disposed below the left end 9*b* so that the protuberance 8*a*becomes elastically buckled, whereby a switch-on signal is output.

Alternatively, when the rotating force applied to the rotatable knob 13 in the state shown in FIG. 4B is released, the buckled protuberance 8*a* regains its original dome-shape by its own elastic force. Thus, the movable contact 18 moves away from the fixed contact 7, thereby switching to an OFF-state. The right end 9*b* is pushed upward by the protuberance 8*a*, forcing the actuator 9 to tilt counterclockwise.

Referring to FIG. 6B, when a rotating operation is performed, since the rotatable knob 13 biases the torsional coil spring 14 to force the torsional coil spring 14 to bend, the elastic repulsive force of the torsional coil spring 14 acts as a force for returning the rotatable knob 13 and the actuator 9 to their original positions. Accordingly, when the rotating force is released, the rotatable knob 13 and the actuator 9 are properly rotated backward to their neutral positions, thereby automatically restoring the neutral state shown in FIG. 4A.

When the operating force is released after the rotating operation, the elastic repulsive force of the protuberance 8*a* pressed by the end 9*b* of the actuator 9 allows the rotatable knob 13 to return automatically to a substantially neutral position. Therefore, the torsional coil spring 14 may alternatively be omitted.

By providing the torsional coil spring 14 serving as a restoring spring after a rotating operation as in this embodiment, even in a case where there is a backlash between the drive portion 13*b* of the rotatable knob 13 and the actuator 9 in a non-operative state, the rotatable knob 13 itself can be maintained in a backlash-free state by means of the torsional coil spring 14. Accordingly, this allows for the dimensional accuracy to be set relatively roughly, and achieves lower component costs and enhanced assembly properties.

An operation implemented in response to pushing of the operating key 15 will be described below. Because the operating key 15 is disposed on the corresponding protuberance 8*a*, the protuberance 8*a* becomes elastically buckled in response to a pushing operation and thus generates a feel of a click. The movable contact 18 inside the protuberance 8*a* comes into contact with the corresponding fixed contact 7, whereby a switch-on signal is output. When the pushing force is released, the buckled protuberance 8*a* regains its original dome-shape by its own elastic force. Thus, the movable contact 18 moves away from the fixed contact 7, thereby switching to an OFF-state. The previously pushed operating key 15 is pressed upward by the protuberance 8*a* and thus returns automatically to its original position. Substantially the same operation is implemented in response to pushing of the operating key 16, and therefore, the description thereof will not be repeated.

In the switch device 1 according to this embodiment, the drive portion 13*b* provided in the rotatable knob 13 tilts the actuator 9 in response to a rotating operation, thus forcing one of the ends 9*b* of the actuator 9 to push against the protuberance 8*a* disposed below the end 9*b*. Because the actuator 9 and the protuberances 8*a* are disposed adjacent to a side of the rotatable knob 13, the housing 19 is reduced in height, thereby facilitating a low-profile structure. In addition, by selecting an appropriate shape for the actuator 9, a desired actuating force and actuating stroke can be readily attained. This switch device 1 is designed such that the front end of the drive portion 13*b* extending parallel to the axial direction of the rotatable knob 13 extends through the cutout 9*c* provided in the central section of the actuator 9, and the drive portion 13*b* slides along one of the engagement portions 9*d* of the actuator 9 in response to a rotating operation performed on the rotatable knob 13. Therefore, the actuator 9 can be tilted smoothly in response to the rotation of the drive portion 13*b*, whereby a stable operation is always attained. The cutout 9*c* of the actuator 9 may alternatively be slit-shaped instead of being notch-shaped.

In the switch device 1 according to this embodiment, the housing 19 includes the upper case 10 combined with the frame-like case 11 having the window 11*a* and the lower case 2 to which the upper case 10 is attached. The actuator 9 is tiltably supported by the lower case 2, and the rotatable knob 13 is rotatably supported by the lower case 2. Therefore, at the time of an assembly process, the circuit board 6, the rubber sheet 8, the actuator 9, and the rotatable knob 13, for example, can all be assembled together in the lower case 2, and the assembly process can be completed by attaching the upper case 10 to the lower case 2. Accordingly, the switch device 1 has enhanced assembly properties.

In the switch device 1 according to this embodiment, since the rubber sheet 8 having the plurality of protuberances 8*a* is disposed on the circuit board 6, the switch device 1 has switch units that can be selectively pushed in response to the various types of operations. Therefore, there is an extremely low possibility of contact failures and short circuits that could be caused when foreign matter, such as dust and moisture, entering the housing 19 from the outside attaches to the contact sections. This contributes to higher reliability of each switch unit, and achieves a less number of components, thereby contributing to enhanced assembly properties. Furthermore, since each protuberance 8*a* can generate a relatively large elastic repulsive force and can clearly generate a feel of a click, good haptic feedback is achieved.

Although the above embodiment is directed to an example of a complex-type switch device 1 in which the rotatable knob 13 has additional operating members (i.e. the operating keys 15, 16) arranged adjacent thereto, the switch device 1 may alternatively include only the rotatable knob 13 as an operating member. In other words, the present invention is applicable to other types of switch devices as well.

In the switch device 1 according to the above embodiment, the tiltably-supporting portion 4 provided in the housing 19 tiltably supports the actuator 9, and the opposite ends 9*b* of the actuator 9 are disposed elastically in contact with the corresponding protuberances 8*a* provided on the rubber sheet 8. At an assembly stage, the actuator 9 can be set in a preloaded state in which the two ends 9*b* receive a reactive force from the protuberances 8*a* disposed below the ends 9*b*. This allows the actuator 9 to be installed in the housing 19 in a backlash-free positioned state, and prevents the rubber sheet 8 from becoming displaced or detached by means of the ends 9*b* of the actuator 9, whereby high assembly efficiency is achieved. When installing the actuator 9, the tilting shaft 9*a* is press-fitted into the space between the pair of walls 4*b* so that the actuator 9 can be joined to the tiltably-supporting portion 4 in a snap-fit fashion, and that the two ends 9*b* can be made elastically in contact with the corresponding protuberances 8*a*. Accordingly, this contributes to extremely high assembly efficiency.

Figure 7:
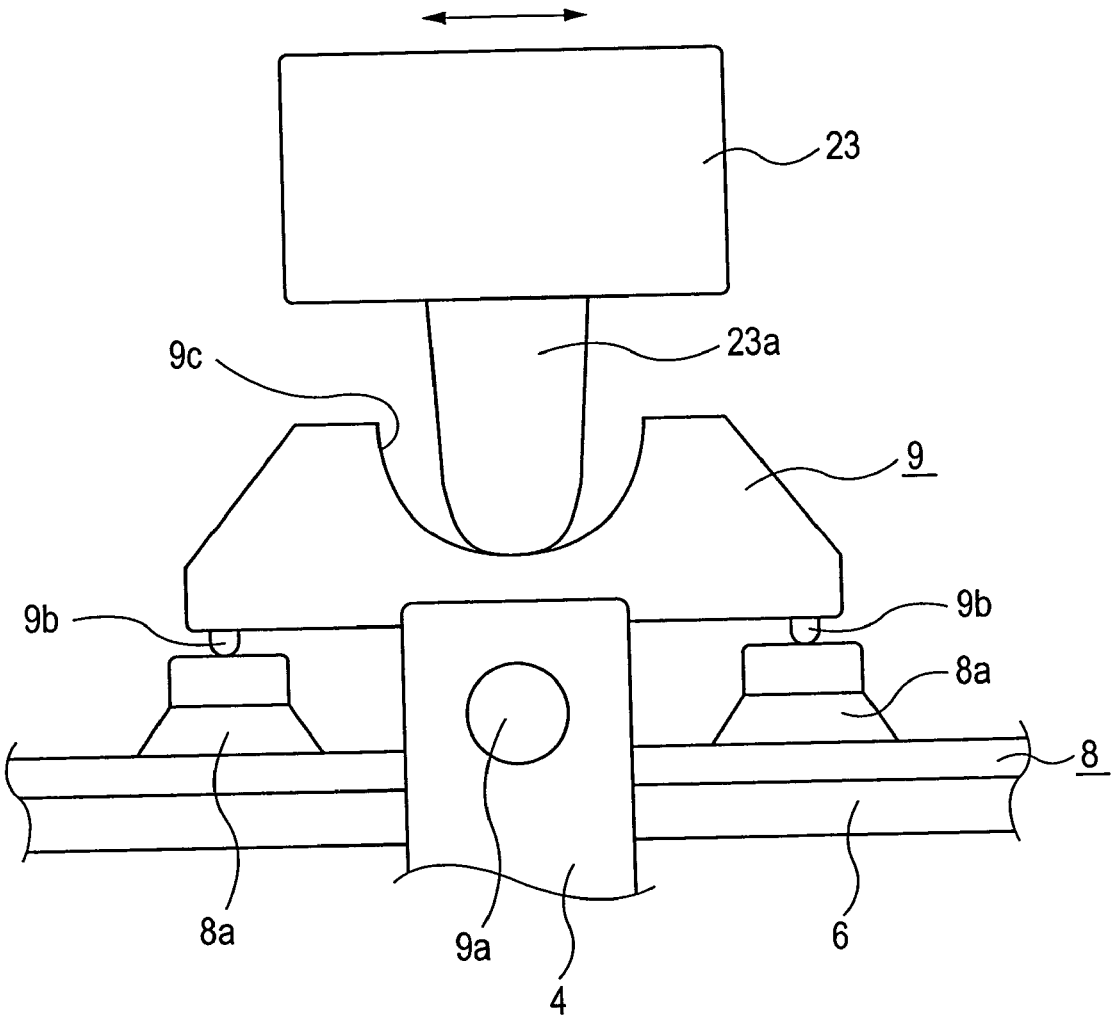
FIG. 7 illustrates a relevant portion of a switch device according to another embodiment.

FIG. 7 illustrates a relevant portion of a switch device according to another embodiment of the present invention. Components in FIG. 7 that correspond to those in FIGS. 1 to 6 are given the same reference numerals, and the descriptions of those components will not be repeated.

The switch device shown in FIG. 7 is a sliding type in which an operating knob 23 can be moved back and forth in the horizontal direction of the drawing. The operating knob 23 has a drive portion 23*a* extending perpendicular thereto. The drive portion 23*a* is slidably engaged to the actuator 9. When the operating knob 23 is operated in a sliding manner, the drive portion 23*a* forces the actuator 9 to tilt. In this embodiment, the cutout 9*c* of the actuator 9 is substantially C-shaped. When the drive portion 23*a* of the operating knob 23 moves in the horizontal direction of the drawing in response to a sliding operation, the drive portion 23*a* allows the actuator 9 to tilt smoothly. The end 9*b* of the actuator 9 at a side toward which the drive portion 23*a* is slid moves downward so as to push the protuberance 8*a* disposed below the end 9*b*. The cutout 9*c* may alternatively be, for example, substantially V-shaped.

As is apparent from the above embodiments, the actuator 9 tiltably supported by the tiltably-supporting portion 4 in the housing 19 can be tilted readily in response to an oblique or lateral driving force applied by the drive portion 13*b* of the rotatable knob 13 or the drive portion 23*a* of the operating knob 23. The switch device according to the present embodiments is readily applicable to various operating types, such as a rotating type and a sliding type, and is therefore highly versatile.

The switch device 1 according to the above embodiments applies a simple mechanism for converting a rotational movement to a vertical movement. For example, in response to a rotating operation performed on the rotatable knob 13, the drive portion 13*b* forces the actuator 9 to tilt so that one of the ends 9*b* of the actuator 9 pushes the protuberance 8*a* disposed below the end 9*b*, whereby a switch-on signal is output. In response to a pushing operating of the operating key 15 or the operating key 16, the key 15 or 16 moves downward so as to push the protuberance 8*a* disposed below the key 15 or 16, whereby a switch-on signal corresponding to the pushing operation is output. When any one of the operations is implemented, the fixed contacts 7 and the movable contacts 18 constituting the switch units to be pushed are kept in a sealed state without being exposed in the internal space of the housing 19. To achieve this in the above embodiments, the rubber sheet 8 having the plurality of protuberances 8*a* is disposed on the circuit board 6 so that the sealing property of the switch units is significantly enhanced. Therefore, in the switch device 1, there is an extremely low possibility of contact failures and short circuits that could be caused when foreign matter, such as dust and moisture, entering the housing 19 from the outside attaches to the contact sections.

In one exemplary embodiment, each of the switch units is given a non-sliding type contact structure in which the fixed contact 7 and the movable contact 18 face each other in a manner such that the two are capable of coming into and out of contact with each other. This implies that even if an operation is repeatedly performed a large number of times, connection failures caused by abrasions in the contact sections are less likely to occur. In this respect, the reliability of the contact sections is also enhanced. In the above embodiments, each switch unit is defined by the movable contact 18 provided inside the corresponding protuberance 8*a* of the rubber sheet 8 and the corresponding fixed contact 7 disposed below the movable contact 18. This structure not only significantly enhances the dustproof and moisture-proof properties in each contact section, but also allows each protuberance 8*a* to generate a relatively large elastic repulsive force and to clearly produce a feel of a click. Accordingly, with a simple structure, improvements in reliability and haptic feedback are achieved.

While the invention has been described above by reference to various embodiments, it should be understood that many changes and modifications can be made without departing from the scope of the invention. It is therefore intended that the foregoing detailed description be regarded as illustrative rather than limiting, and that it be understood that it is the following claims, including all equivalents, that are intended to define the spirit and scope of this invention.

What is claimed is:

1. A switch device comprising:

a housing having a window in an operating surface thereof;

an operating member that is rotatably supported within the housing and is partly exposed through the window;

a pair of switch units disposed on a circuit board in the housing and which generates an elastic repulsive force against a pushing force; and an actuator tiltably supported within the housing and having a pair of ends that are respectively disposed on the pair of switch units, wherein the actuator is disposed adjacent to the operating member, and wherein the operating member has a rotating shaft whose one end is provided with a drive portion that is given a predetermined radius of rotation, wherein the drive portion is slidably coupled to the actuator and is operating to tilt the actuator in response to a rotating operation performed on the operating member so that one of the ends pushes the corresponding switch unit.

2. The switch device according to claim 1, wherein a central section of the actuator in a tilting direction thereof is provided with a notch-like or slit-like cutout through which the drive portion extends.

3. The switch device according to claim 1, wherein the extending section of the drive portion is parallel to an axial direction of the rotating shaft.

4. The switch device according to claim 1, further comprising a restoring spring which is coupled to the operating member and generates a restoring force in response to the rotating operation.

5. The switch device according to claim 4, further comprising a restoring spring which is coupled to the operating member and generates a restoring force in response to the rotating operation.

6. The switch device according to claim 5, wherein the housing includes an upper case having a window and a lower case attached to the upper case, and wherein the actuator is tiltably supported by the lower case and the operating member is rotatably supported by the lower case.

7. The switch device according to claim 6, wherein each of the switch units includes a fixed contact fixed on the circuit board; a dome body disposed on the circuit board that surrounds the fixed contact, the dome body operable to be elastically buckled; and a movable contact attached to an interior of the dome body and faces the fixed contact in a manner such that the movable contact is capable of moving into and out of contact with the fixed contact, wherein the movable contact moves into contact with the fixed contact when the dome body is pushed and becomes buckled.

8. The switch device according to claim 1, wherein the housing includes an upper case having a window and a lower case attached to the upper case, and wherein the actuator is tiltably supported by the lower case and the operating member is rotatably supported by the lower case.

9. The switch device according to claim 1, wherein each of the switch units includes a fixed contact fixed on the circuit board; a dome body disposed on the circuit board that surrounds the fixed contact, the dome body operable to be elastically buckled; and a movable contact attached to an interior of the dome body and faces the fixed contact in a manner such that the movable contact is capable of moving into and out of contact with the fixed contact, wherein the movable contact moves into contact with the fixed contact when the dome body is pushed and becomes buckled.

10. A steering switch apparatus comprising a housing having a window in an operating surface thereof;

an operating member that is rotatably supported within the housing and is partly exposed through the window;

a pair of switch units disposed on a circuit board in the housing and which generates an elastic repulsive force against a pushing force; and an actuator tiltably supported within the housing and having a pair of ends that are respectively disposed on the pair of switch units, wherein the actuator is disposed adjacent to the operating member, and wherein the operating member has a rotating shaft whose one end is provided with a drive portion that is given a predetermined radius of rotation and wherein the housing is installed in a steering wheel, wherein the drive portion is slidably coupled to the actuator and is operable to tilt the actuator in response to a rotating operation performed on the operating member so that one of the ends pushes the corresponding switch unit.

11. A switch device comprising:

a circuit board disposed inside a housing;

a rubber sheet disposed on the circuit board and having protuberances at a plurality of positions, the protuberances capable of being elastically buckled;

a tiltably-supporting portion and positioning pins positioned on an inner side of a lower case of the housing, wherein the circuit board has a cutout section that provides an installation space for the tiltably-supporting portion and has a plurality of through holes through which the positioning pins extend, and wherein the rubber sheet has a cutout section at a position directly above the cutout section of the circuit board so as to provide an installation space for the tiltably-supporting portion and has pin-engagement portions to be engaged on the positioning pins;

an actuator tiltably supported by the tiltably supporting portion; and an operating member which has a drive portion engaged to the actuator and is partly exposed on an exterior of the housing, wherein each of the protuberances has a movable contact disposed therein, the movable contact faces a corresponding one of fixed contacts provided on the circuit board in a manner such that the movable contact is capable of moving into and out of contact with the fixed contact, wherein the actuator has ends that are respectively disposed on the corresponding protuberances in a manner such that each end is elastically in contact with the corresponding protuberance, and wherein when the operating member is operated, the drive portion tilts the actuator so that one of the ends buckles the corresponding protuberance.

12. The switch device according to claim 11, wherein the actuator is rotatably attached to the tiltably-supporting portion in a snap-fit fashion.

13. The switch device according to claim 12, wherein the actuator includes a tilting shaft whose center of axle is aligned with a tilting axis of the actuator, wherein the tiltably-supporting portion includes a pair of walls standing substantially in parallel to each other, the walls being respectively provided with shaft holes at opposing positions of the walls, and wherein opposite ends of the tilting shaft are rotatably attached to the shaft holes.

14. A steering switch apparatus comprising the switch device according to claim 11, wherein the housing is installed in a steering wheel.

* * * * *